US007740240B2

(12) United States Patent
Iwakiri

(10) Patent No.: US 7,740,240 B2
(45) Date of Patent: Jun. 22, 2010

(54) PAPER FEEDING APPARATUS FOR FEEDING SHEETS OF PAPER

(75) Inventor: Shinichi Iwakiri, Kanagawa-ken (JP)

(73) Assignee: Duplo Corporation (JP)

( * ) Notice: Subject to any disclaimer, the term of this patent is extended or adjusted under 35 U.S.C. 154(b) by 310 days.

(21) Appl. No.: 11/763,455

(22) Filed: Jun. 15, 2007

(65) Prior Publication Data

US 2008/0067733 A1 Mar. 20, 2008

(30) Foreign Application Priority Data

Jun. 19, 2006 (JP) ..... 2006-169148
May 10, 2007 (JP) ..... 2007-125614

(51) Int. Cl.
*B65H 3/08* (2006.01)

(52) U.S. Cl. ..... 271/97; 414/676; 271/90

(58) Field of Classification Search ..... 271/90, 271/97; 414/676; 269/20, 21; *B65H 1/26; B65G 51/03*
See application file for complete search history.

(56) References Cited

U.S. PATENT DOCUMENTS 2,950,107 A 8/1960 Royer
4,387,890 A * 6/1983 Lampe ..... 271/225
5,271,706 A 12/1993 Helbach et al.
2005/0040586 A1 * 2/2005 Takata ..... 271/100

FOREIGN PATENT DOCUMENTS

DE 2229814 11/1973
DE 10151917 A1 4/2003
JP 05-319669 12/1993
JP 2004284783 10/2004

OTHER PUBLICATIONS

"EPO Communication for EPO7252271.7-2314, Issued Nov. 11, 2007".

* cited by examiner

*Primary Examiner*—Kaitlin S Joerger
(74) *Attorney, Agent, or Firm*—Carr & Ferrell LLP

(57) ABSTRACT

In a paper feeding apparatus, a paper feeding unit has a paper mounting surface provided with an air-blowing outlet. The paper feeding structure feeds an uppermost sheet of a stack of paper on the paper mounting surface. An air pump supplies air to an air-blowing outlet, a first air-blowing member and a second air-blowing member. The air-blowing outlet is so provided as to blow air to an approximately whole undersurface of the paper stacked on the paper mounting surface. When air is being supplied to the air-blowing outlet, an electronic control unit inhibits the feeding of sheets of paper by the paper feeding unit.

17 Claims, 11 Drawing Sheets

PAPER FEEDING APPARATUS FOR FEEDING SHEETS OF PAPER

CROSS-REFERENCE TO RELATED APPLICATIONS

The present application claims the priority benefit of Japanese patent application number 2006-169148 filed Jun. 19, 2006 and Japanese patent application number 2007-125614 filed May 10, 2007. The disclosure of each of the aforementioned patent applications is incorporated herein by reference.

BACKGROUND OF THE INVENTION

1. Field of the Invention

The present invention relates, generally) to a paper feeding apparatus and, more specifically, to an apparatus for feeding the uppermost sheet of paper from a stack of paper.

2. Description of the Related Art

Laid-open Japanese patent publication number H05-319669 discloses an example of a multi-functional document integrating apparatus that carries out post-processing such as bookbinding. The apparatus of the '669 publication achieves such post-processing by successively taking out the uppermost sheet of paper from a stack of paper loaded on a tray. Such an apparatus requires the advance stacking of sheets of paper on the tray in the order of processing that will follow.

When stacking sheets of paper on such a tray, it is difficult to place them in the correct horizontal position that assures proper feeding of the uppermost sheet of paper. For example, where the sheets of paper are stacked by various types of paper stacking apparatuses, the stacked position of sheets on the tray may vary with the paper stacking apparatuses and the sizes of the sheets of paper whereby it may be all the more difficult to stack the sheets in correct position. Hence, it is a general practice that after the sheets have been stacked on a tray, the user manually shifts the stacked sheets of paper to a position appropriate for paper feeding. A user generally shifts the stacked sheets of paper to a position appropriate for paper feeding after the sheets have been stacked on a tray.

There often occurs friction between the stacked paper and tray, however, when the stacked sheets of paper are moved in a horizontal direction. This friction makes it difficult to move the slack of paper horizontally while retaining the form of the stack. As such, there is a need in the art to overcome such difficulties.

SUMMARY OF THE INVENTION

Various embodiments of the present invention may overcome the above-mentioned problems by providing a paper feeding apparatus that allows an easy shifting of a stack of sheets loaded on a paper tray to a proper horizontal position for sheet feeding.

In one such embodiment, an exemplary paper feeding apparatus includes a paper tray having a paper mounting surface provided with an air-blowing outlet and an air supplying structure that supplies air to the air-blowing outlet. The apparatus further includes a paper feeder for feeding an uppermost sheet of a stack of paper on the paper mounting surface. The air-blowing outlet in this particular embodiment is disposed as to blow air against an approximately whole undersurface of the paper stacked on the paper mounting surface.

In another embodiment, an exemplary paper feeding apparatus includes an air-blower arranged to blow air against the upper-end side of a stack of paper and a switching structure arranged to switch a destination of air supplied from the air supplying structure to either of the air-blowing outlet and the air-blower.

A paper feeding apparatus, in accordance with certain embodiments of the present invention, may further include a control unit that inhibits the feeding of sheets of paper by the paper feeder when air is being supplied to the air-blowing outlet from the air supplying structure.

A paper feeding apparatus, in accordance with certain embodiments of the present invention, may further include an opening-closing sensor that detects opening/closing of a door. A preventive structure may be arranged in such an embodiment to prevent the closing of the door when a destination of air supplied from the air supplying structure has been switched to the air-blowing outlet. A control unit may be provided to inhibit the feeding of sheets of paper by the paper feeder when the opening of the door has been detected.

In some embodiments, the paper tray may be detachable. In other embodiments, the tray may be attached and an air passage connecting to the air supplying structure and an air passage connecting to the air-blowing outlet may be coupled with each other such that air is supplied from the air supplying structure to the air-blowing outlet.

In yet another embodiment of the present invention, a paper feeding apparatus includes an instruction input unit operative to receive an instruction input for paper feeding from a user. The apparatus may further include a control unit that controls a switching structure to switch a destination of air supply to the air-blower when the destination of air supply has been switched to the air-blowing outlet at the time of reception of an instruction input for paper feeding.

The paper tray in embodiments of the present invention may include a paper feed plate and a slipping sheet. The slipping sheet may have a smaller coefficient of friction against the sheet of paper than the paper feed plate and configured to be fitted onto the paper feed plate in such a manner as to form a paper mounting surface.

The paper feed plate may include a first opening and the slipping sheet may include a second opening. The first opening and the second opening, of which one may have a wider opening area than the other, may be disposed one on top of the other to form the air blowing outlet.

The slipping sheet may be formed of any of fluororesin material, nickel-fluororesin material, graphite resin material, or molybdenum disulfide resin material.

The air blower may include a side-air blower arranged to blow air to a side and parallel to a transport direction of a stack of paper in the vicinity of a front end in the transport direction.

The air blower may include a side-air blower arranged to blow air to a side and parallel to a transport direction of a stack of paper in the vicinity of a rear end in the transport direction.

The air blower may include a first side-air blower arranged to blow air to one side and parallel to a transport direction of a stack of paper in the vicinity of a front end in the transport direction. The air blower may further include a second side-air blower arranged to blow air to the other side and parallel to the transport direction of a stack of paper in the vicinity of a rear end in the transport direction.

A paper feeding apparatus, in some embodiments, may further include a buffer structure which temporarily halts a plurality of stacked papers transported from the paper tray. The air blower may include a buffer air blower arranged to blow air to an undersurface of paper entering the buffer mechanism.

DETAILED DESCRIPTION

The invention will now be described by reference to various embodiments. The following embodiments are not intended to limit the scope of the present invention but rather to exemplify the same.

Figure 1:
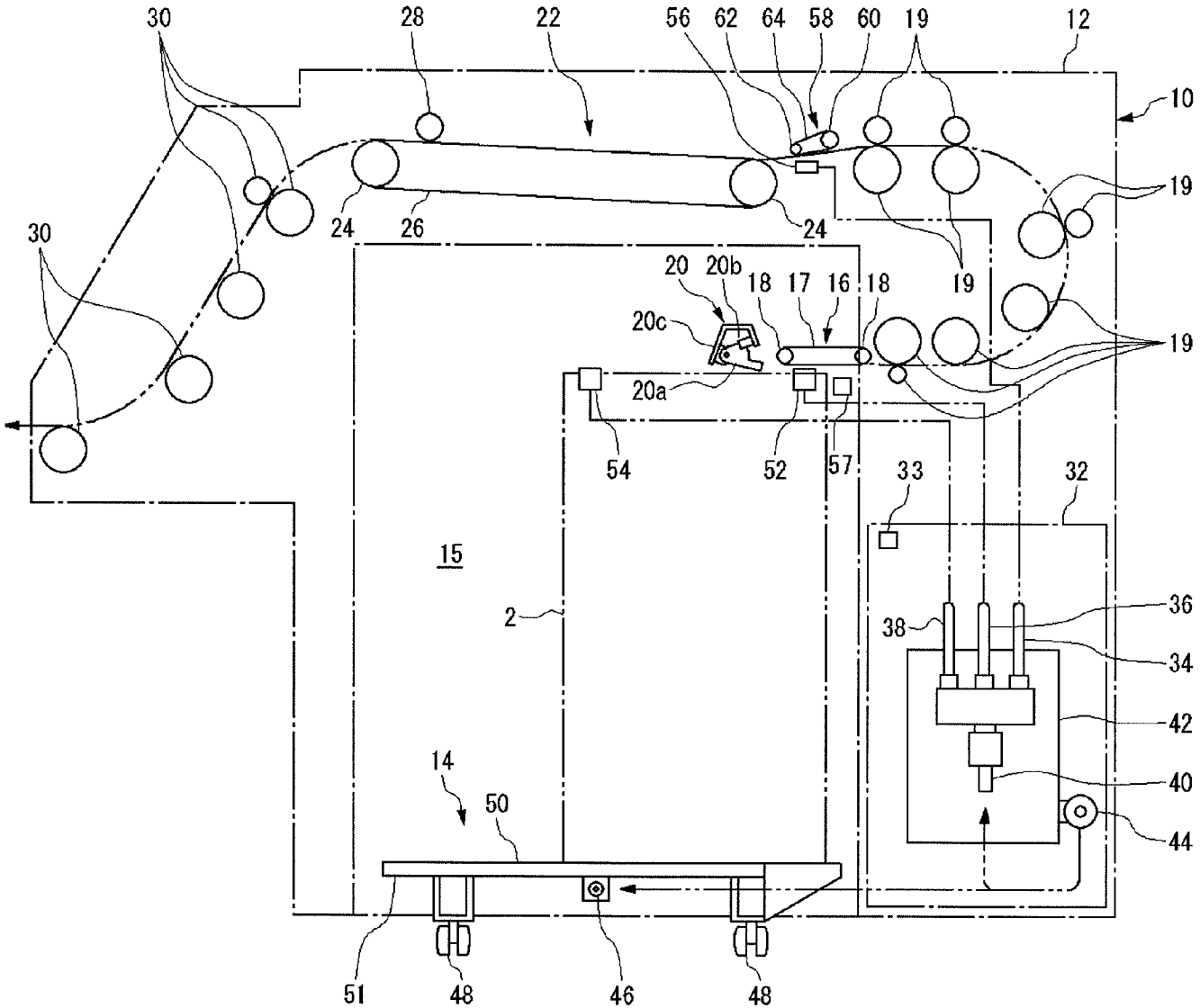
FIG. 1 is a front view of a paper feeding apparatus according to a first embodiment of the present invention.
Figure 2:
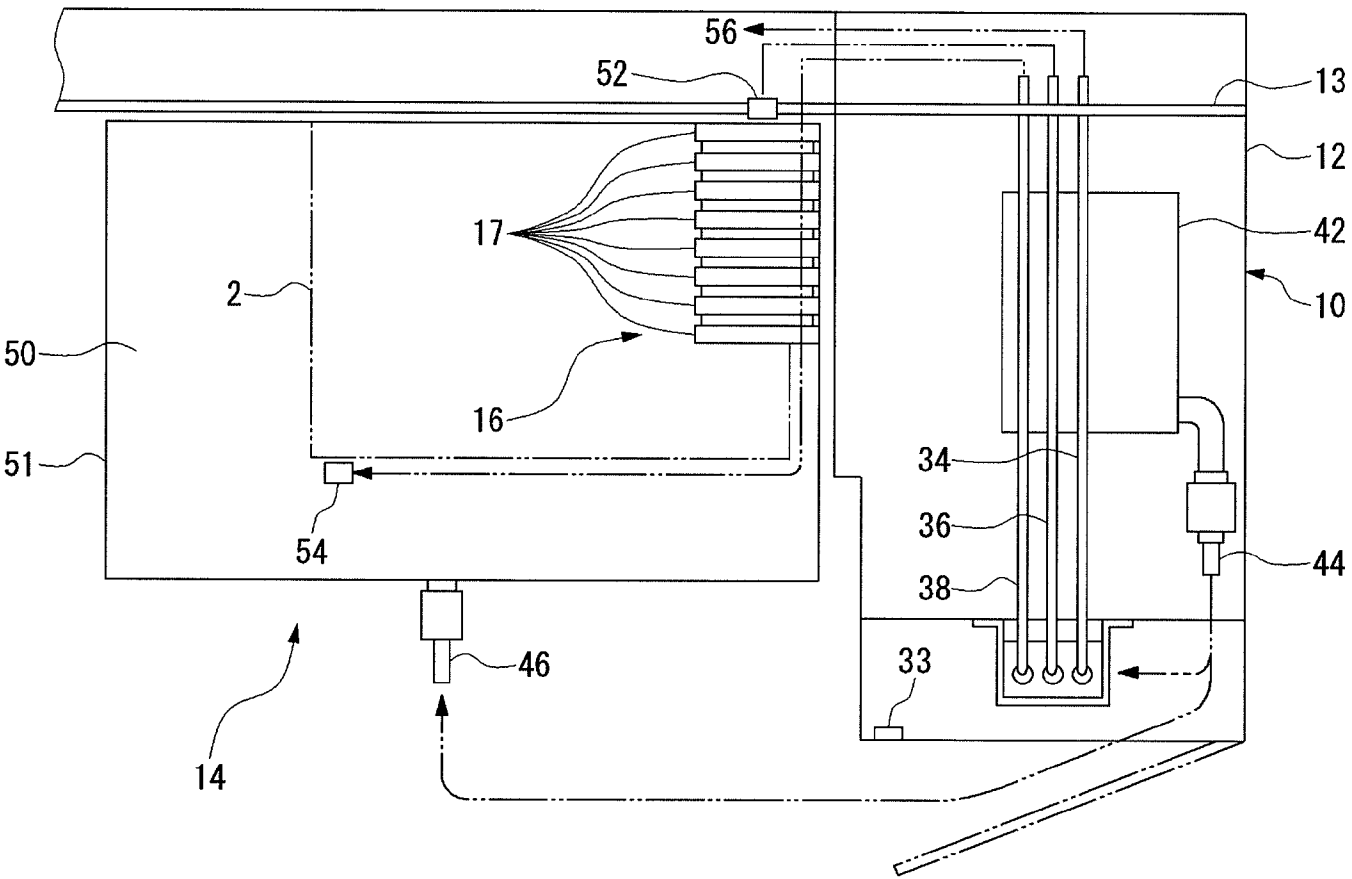
FIG. 2 is a top view of the paper feeding apparatus according to a first embodiment of the present invention.

FIG. 1 is a front view of a paper feeding apparatus 10 according to a first embodiment of the present invention. FIG. 2 is a top view of the paper feeding apparatus 10. FIG. 1 illustrates an internal structure of the paper feeding apparatus 10 by representing an outside cover and the like with a two-dot chain line.

The paper feeding apparatus 10 of FIG. 1 includes a body 12 and a paper tray 14. The paper feeding apparatus 10 of FIG. 1 further includes a paper feeder 16, a paper height sensor 20, an air-blowing structure 57, a first air-blowing member 52, a second air-blowing member 54, and a buffer mechanism 22. Approximately in the center of the body 12 is a paper stack container 15, which has a spatial area capable of opening frontward and downward. Sheets of paper may be stacked on the paper tray 14. The paper stack container 15 holds both the paper tray 14 and sheets of paper stacked thereon.

The paper feeder 16 may include a plurality of paper-feeding belts 17 and two rollers 18. The paper-feeding belts 17 each have the same width and the same perimeter and are engaged around the outer peripheries of the two rollers 18 at equal intervals in the axis direction thereof. The paper feeder 16 is disposed in an upper right position of the paper stack container 15 and fixed to a frame 13 of the body 12 in such a manner that the axes of the rollers 18 extend in the front-back direction thereof and the two rollers are lined up right and left thereof.

One of the rollers 18 may be driven by a motor (not shown), thereby driving all the paper-feeding belts 17. In this arrangement, the motor drives the roller 18 such that the lower surfaces of the paper-feeding belts 17 move in the direction of paper feeding. The paper feeder 16 may also be provided with an air suction structure (not shown) that sucks air from the underside of the paper-feeding belts 17. As the paper-feeding belts 17 are driven with sheets of paper stacked to a predetermined height and air is sucked from the underside of the paper-feeding belts 17, the uppermost sheet of the stacked sheets of paper is stock under suction to the under surface of the paper-feeding belts 17 and sent out rightward in the apparatus. In the presently illustrated embodiment, the air suction structure has a fan. Air flow for sucking air from the underside of the paper-feeding belts 17 is formed by the operation of the fan.

The paper feeding apparatus 10 includes an electronic control unit (not shown). The electronic control unit, which may includes a CPU, RAM, ROM, and the like, controls the operation of various actuators, such as motors and solenoids, mounted on the paper feeding apparatus 10.

The motor that drives the paper-feeding bells 17 is coupled to the electronic control unit, which controls the on, off, and other operations of the paper-feeding belts 17. The air suction structure is provided with a solenoid capable of driving a lid member to open and close an opening provided in an air conduit. When the solenoid is off, the opening is opened to weaken the air suction from the underside of the paper-feeding belts 17 so that the suction of a sheet of paper to the undersurface thereof is restricted. When the solenoid is on, the opening is closed to strengthen the air suction from the underside of the paper-feeding belts 17, so that the sheet of paper is sucked to the undersurface thereof. This solenoid is also coupled to the electronic control unit, which controls the on and off of the solenoid, thereby controlling the suction of the sheet of paper to the paper-feeding belts 17. In this manner, the electronic control unit controls the feeding of the uppermost sheet of the stack of paper placed on the paper tray 14 by controlling the drive of the paper-feeding belts 17 and the suction of the sheet to the undersurface of the paper-feeding belts 17.

The air-blowing structure 57 functioning as an air blower is disposed below the paper feeder 16 and in the vicinity of an upper end in a downstream side of the stack of paper. The air-blowing structure 57 blows air toward an upper end of stacked paper from a downstream side of a paper feeding direction. The air blown from the air-blowing structure 57 makes an uppermost sheet of paper float above sheets of paper there below and reduces friction between them and makes it possible to enhance the transportability of papers. The air-blowing structure 57 includes a fan (not shown) and the electronic control unit controls this fan so as to control the blowing of air by the air-blowing structure 57. Note that the air-blowing structure 57 may blow the air utilizing the air supplied form an air pump described later.

The paper height sensor 20 is provided with a turning plate 20*a*, a light sensor 20*b*, and a sensor frame 20*c*. The turning plate 20*a* is rotatably supported by the sensor frame 20*c*. The light sensor 20*b*, which is fixed to the sensor frame 20*c*, detects the turning of the turning plate 20*a* to a predetermined angle. The paper height sensor 20 is disposed in the left-hand area of the paper feeder 16 and is fixed to the frame 12 such that the turning plate 20*a* projects slightly downward from the undersurface of the paper-feeding belts 17. As a result of this arrangement, the stack of paper rises and lowers together with the paper tray 14 and the turning plate 20*a*, in contact with the uppermost sheet of the stack, turns as the stack of paper rises. Both the light sensor 20*b* and turning plate 20*a* are so disposed that the light sensor 20*b* detects the taming of the turning plate 20*a* to a predetermined angle as the uppermost sheet of the stack of paper is lifted to a height appropriate for feeding.

The first air-blowing member 52, which may be disposed in the right end vicinity of the rear side of the stack of paper and also in the vicinity of the uppermost sheet of the stack of paper, blows air frontward as the air is supplied. Thus the first air-blowing member 52 functions as an air blower arranged to blow air to the upper-end side of the stack of paper. The second air-blowing member 54, which may be disposed in the left end vicinity of the front side of the stack of paper and also in the vicinity of the uppermost sheet of the slack of paper, blows air rearward as the air is supplied. Thus the second air-blowing member 54 also functions as an air-blower arranged to blow air to the upper-end side of the stack of paper. With air blown from the first air-blowing member 52 and the second air-blowing member 54 in cooperation with the air blowing by the aforementioned air-blowing structure 57, a layer of air is formed between the uppermost sheet and the sheet beneath it of the stack of paper thereby facilitating the feeding of the uppermost sheet by reducing friction between the sheets of paper.

Provided where a sheet of paper is sent out from the paper feeder 16 is a curved paper transport path. The transport path raises the sheet of paper and reverses the paper transport direction from rightward to leftward. In this curved paper transport path, the sheet of paper is transported by rollers 19.

A roller unit 58 is provided on the left side of the curved paper transport path, which is the downstream side of the paper transport direction (the "downstream side"). The roller unit 58, in one embodiment, is comprised of a conveying belt 64, a roller 60, and a roller 62. The conveying belt 64 is put on the peripheries of the roller 60 and the roller 62, and the undersurface of the conveying belt 64 forms a paper transport path to lead a sheet of paper obliquely downward.

Provided on the downstream side of the roller unit 58 is a buffer mechanism 22. The buffer mechanism 22 is comprised of a conveying belt 26, rollers 24, and a halting roller 28. The conveying belt 26 is put on the peripheries of the two rollers 24, and the top surface of the conveying belt 26 forms a paper transport path, to lead a sheet of paper obliquely upward.

The halting roller 28 is in contact with the top surface of the conveying belt 26. Below the halting roller 28 is a halting member (not shown). The halting member has substantially the same length as the length of the top surface of the conveying belt 26 in the paper transport direction. The halting member is rotatably fitted on the frame 13 with the supporting point located on the upstream side of the paper transport direction (the "upstream side"). When halting a sheet of paper in the buffer mechanism 22, the halting member is rotated upward until it comes into contact with the halting roller 28. At this time, the halting member is rotated to the point where the top surface of the halting member is located above the fop surface of the conveying belt 26. This arrangement facilitates halting a sheet of paper above the conveying belt 26 while the belt 26 is running.

A third air-blowing member 56 blows air along fee top surface of the conveying belt 26 from the upstream side to the downstream side of the buffer mechanism 22. This arrangement helps to ensure that the front end of a sheet entering the buffer mechanism 22 lifts slightly upward. This upward lifting helps prevent the front end of a sheet to be halted on top of a previous sheet from hitting the rear end of the sheet already halted on the top surface of the halting member. As a result, the obstructed advance of the sheet to be conveyed may be avoided. This configuration also forms a layer of air between the top surface of the sheet already halted on the top surface of the halting member and the undersurface of the sheet to be halted on top of the former. As a result, friction between the two sheets is reduced. In this manner, the air blown from the third air-blowing member 56 helps realize a smooth halting of the sheets of paper in the buffer mechanism 22.

A paper transport path provided on the downstream side of the buffer mechanism 22 is formed such that it leads downward first and then horizontally. A sheet of paper having been transported to this paper transport path is now conveyed by rollers 30 and discharged from the body 12 of this paper feeding apparatus. When there is a stack of sheets of paper made by the buffer mechanism 22, the stack of sheets of paper are conveyed, and discharged the same way. The sheets of paper discharged from the body 12 are sent to a finishing apparatus, such as a sheet folder, sheet binder, or sheet puncher.

A paper feeding apparatus 10 may further include an air pump 42, a first pipe 34, a second pipe 36, a third pipe 38, a second air valve 40, a first air valve 44, a door 32, and an opening/closing sensor 33. The door 32 may be provided on the front of the body 12 on the right; of the paper stack container 15. The opening/closing sensor 33, which is disposed close to the door 33, detects the opening/closing thereof. The opening/closing sensor 33 is connected to the electronic control unit, and the result of detection thereby is outputted to the electronic control unit.

The air pump 42 is provided inside the body 12 on the right of the paper stack container 15. Connected to the air pump 42 is a first air valve 44. The first pipe 34, the second pipe 36, and the third pipe 38 are also provided inside the body 12. The first pipe 34 is connected to the third air-blowing member 56. The second pipe 36 is connected to the first air-blowing member 52. The third pipe 38 is connected to the second air-blowing member 54. The first pipe 34, the second pipe 36, and the third pipe 38 are together connected to the single second air valve 40. The air pump 42, the first air valve 44, and the second, air valve 40 may be disposed in such positions as allow a user to access easily by opening the door 32.

Coupled to the first air valve 44 is one end of a hose (not shown). The other end of the hose is coupled to the second air valve 40. As the air pump 42 is turned on, air is supplied to each of the first air-blowing member 52, the second air-blowing member 54, and the third air-blowing member 56. To start paper feeding by the paper feeding apparatus 10, the user couples the other end of the hose to the second air valve 40. Note that paper feeding by the paper feeding apparatus 10 and as referred to herein may be representative of the action of feeding the uppermost sheets of paper, one by one, from a stack of paper by the paper feeder 16. The door 32 is of such design that it can be closed, by stowing away the hose inside the body 12 even when the hose is coupled to the second air valve 40.

Figure 3:
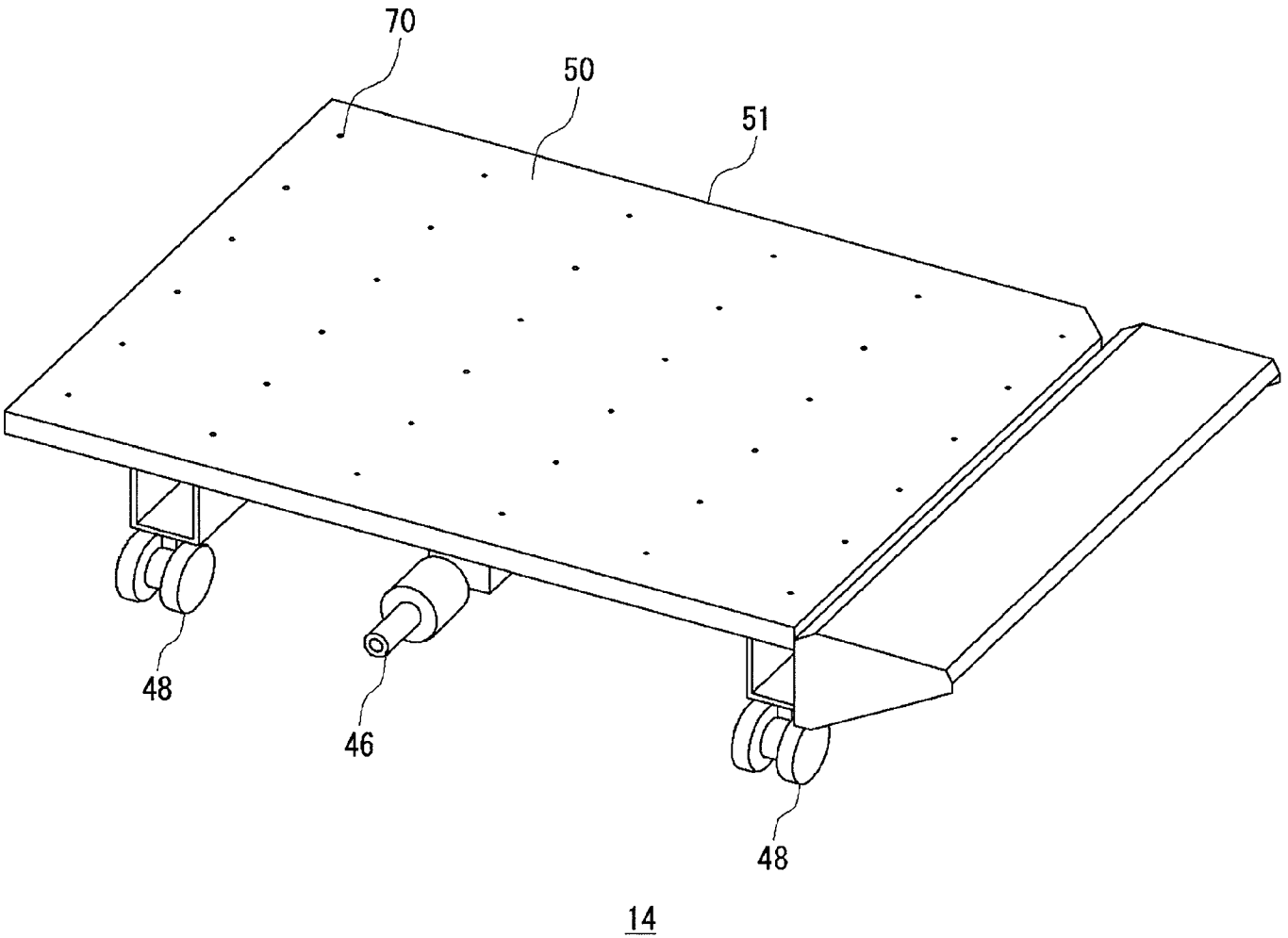
FIG. 3 is a perspective view showing an appearance of a paper tray.

The paper tray 14 is detachably attached to the body 12. The paper tray 14 will now be described in detail by referring to FIG. 3, which is a perspective illustration showing the appearance thereof. The paper tray 14 as illustrated in FIG. 3 includes a fray plate 51, a third air valve 46, and castors 48. The tray plate 51 is a plate having a rectangular external form, which has a hollow interior. The third air valve 46 is disposed underneath the tray plate 51 in such a manner that it projects to the front of the paper tray 14. The third air valve leads to the hollow part of the tray plate 51.

Formed on the top surface of the tray plate 51 is a paper mounting surface 50, and sheets of paper are stacked thereon. Provided in the paper mounting surface 50 are a plurality of air-blowing outlets 70, which are in communication with a hollow interior portion of the tray plate 51. With air supplied from the third air valve 46 to the hollow part inside the tray plate 51, air blows out of the air-blowing outlets 70 to the area above the paper mounting surface 50. The air-blowing outlets 70, which may be holes of a substantially identical diameter, are disposed at equal intervals in the whole area of the paper mounting surface 50 so that air blows out substantially evenly in the whole area of the undersurface of the paper stacked on the paper mounting surface 50.

The paper tray 14, according to the first embodiment, can be removed from, the body 12. It is possible to stack sheets of paper on the paper mounting surface 50 by multiple types of paper stacking apparatuses. The multiple types of paper stacking apparatuses include image recording equipment for recording images on paper, such as printing machines, copiers, and printers. When sheets of paper are stacked by these multiple types of paper stacking apparatuses, the stacked position of sheets on the paper mounting surface 50 can vary with the types of paper stacking apparatuses or the sizes of the sheets of paper.

With an apparatus for feeding the uppermost sheet of a stack of paper by the paper feeder 16, such as a paper feeding apparatus 10 according to the first embodiment, it may be difficult to feed the uppermost sheet properly. This may be particularly true when the stacked sheets are not in proper horizontal position relative to the paper feeder 16. Hence, when sheet's of paper are stacked on the paper tray 14 by various types of paper stacking apparatuses, it may be necessary to shift the stacked sheets of paper to a proper horizontal position relative to the paper feeder 16.

Generally such a shifting operation is performed manually by the user. More specifically, before or after the user installs the paper fray 14 with sheets of paper stacked thereon on the body 12, the user pushes one side of the stack of paper to have the other side thereof pressed against a stopper or the like. By pushing the stack in such a manner, the stack is shifted to a horizontal position appropriate for paper feeding. When shifting the stack of paper, however, there occurs friction between the undersurface of the lowermost sheet of the stack and the paper mounting surface 50. The friction may be even greater especially with paper feeding apparatuses, which, may allow the stacking of a large number of sheets on the paper such as tray 14. Therefore, unless some measure to reduce the friction is taken, it may be difficult to shift the stack of paper horizontally while retaining the form of the stack.

To resolve this difficulty, a paper feeding apparatus like that according to the first embodiment (apparatus 10) may include a paper mounting surface 50 provided with air-blowing outlets 70. When air is blown out of the air-blowing outlets 70 to the area above the paper mounting surface 50, a layer of air is formed between the undersurface of the lowermost sheet of the stack and the paper mounting surface 50 thus reducing the friction there between. As a result of the reduced friction, the user can easily shift the stack of paper horizontally on the paper mounting surface 50. Moreover, the air-blowing outlets 70 disposed evenly in the whole area of the paper mounting surface 50 make it easier to shift the stack of paper horizontally even when the sheets of paper are stacked in various positions on the paper mounting surface 50 by various paper stacking apparatuses. Further, the surface of the paper mounting surface 50 may be coated with fluororesin material, nickel-fluororesin material, graphite resin material, molybdenum disulfide resin material, or the like to further lessen the friction with the sheet of paper.

Castors 48 are provided under the tray plate 51. When the paper tray 14 is removed from the body 12, the castors 48 allow the paper tray 14 to travel by coming into contact with the floor.

Referring back to FIG. 1 and FIG. 2, when the hose coupled at one end to the first air valve 44 is coupled to the third air valve 46 at the other end and the air pump 42 is turned on, air is supplied to the hollow part of the fray plate 51. Thus, air is blown out of the air-blowing outlets 70 toward the area above the paper mounting surface 50. In order to shift the stack of paper on the paper mounting surface 50 horizontally to an appropriate position, the user couples the other end of the hose to the third air valve 46. When the hose is coupled to the third air valve 46, the arrangement is such, that the door 32 cannot be closed because the hose is in the way. Thus, the hose coupled to the first air valve 44 functions as a preventive structure arranged to prevent the closing of the door 32 when the destination of air supplied from the air pump 42 has been switched to the air-blowing outlets 70.

When the hose is coupled to the second air valve 40, the air pump 42 supplies air to the first air-blowing member 52, the second air-blowing member 54, and the third air-blowing member 56. Also, when the hose is coupled to the third air valve 46, the air pump 42 supplies air to the paper tray 14. In this manner, the air pump 42 is used for the supply of air for paper feeding and also for the horizontal shifting of the stack of paper on the paper mounting surface 50. Hence, the hose, the second air valve 40, and the third air valve 46 may function as a switching mechanism. Such a mechanism may be manually operated, by the user to switch the destination of air supplied by the air pump 42 as an air supply structure to the first air-blowing member 52 and the second air-blowing member 54 or to the paper tray 14.

There is no particular necessity for the air blowing from the first air-blowing member 52 and the second air-blowing member 54 and the air blowing from the paper mounting surface 50 to occur simultaneously. With the paper feeding apparatus 10 according to the first embodiment, the user switches the destination of air supply by changing the object to which the hose is coupled so that air will not be supplied to the second air valve 40 and the third air valve 46 simultaneously.

Figure 4:
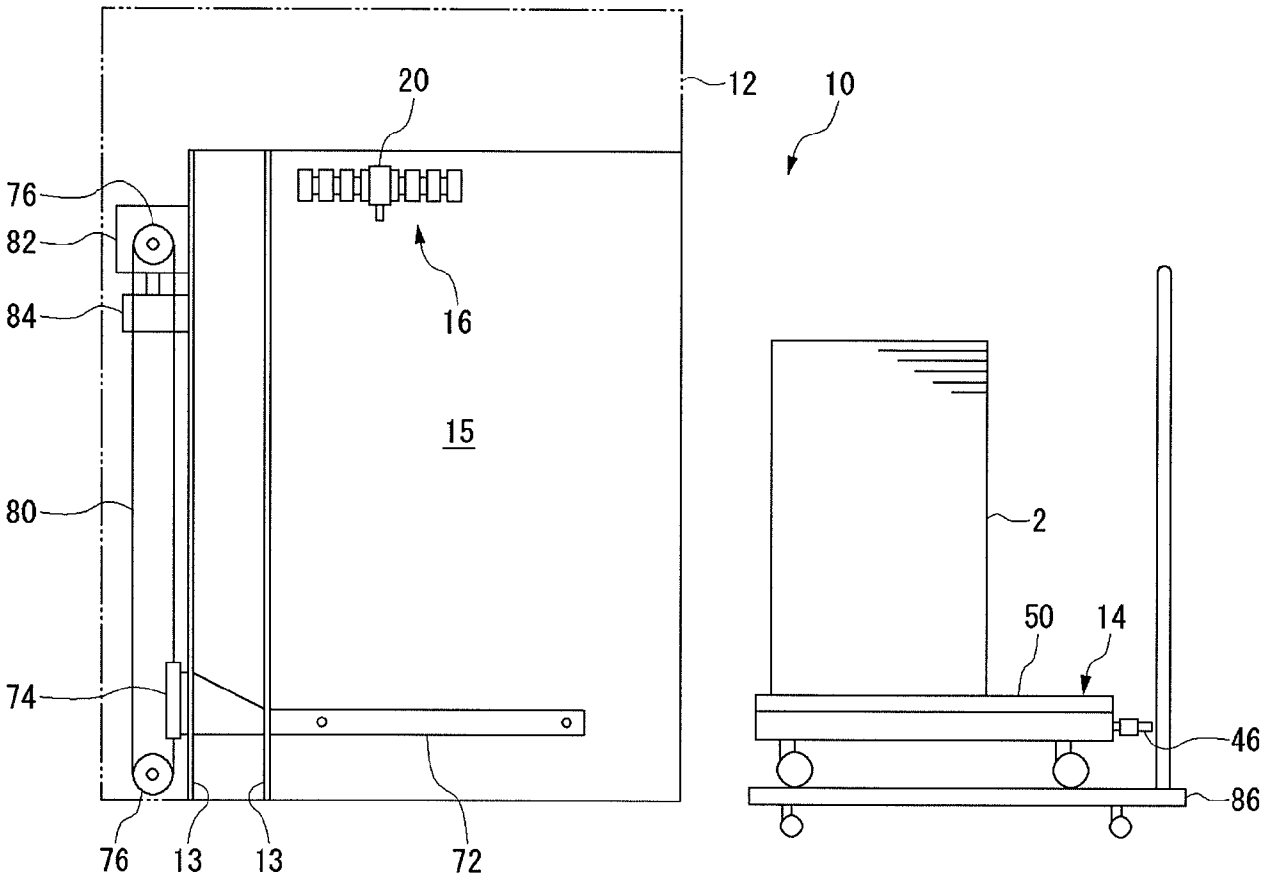
FIG. 4 is a right side view of the paper feeding apparatus, of which a paper tray has been removed from a body thereof.

FIG. 4 is a right side view of a paper feeding apparatus 10, of which the paper tray 14 has been removed from the body 12 thereof. The body 12 further includes two rods 72, two chains 80, and a single motor 84. The two rods are elongated plates of the same shape.

The two rods are fixed to each other by a connecting shaft (not shown) in such a manner that they extend in parallel with each other with a space in between. Rollers 76 are disposed in parallel in an upper and a lower position behind frames 13 of the apparatus. The chains 80 are engaged around the peripheries of the rollers 76. Two sets of these rollers 76 and chains 80 are disposed in parallel on the right and left positions of the apparatus. At this time, the rods 72 are disposed inside the paper stack container 15 in such a manner as to protrude toward the front of the apparatus.

The center shaft of the upper rollers 76 is coupled to the motor 84 via reduction gears 82. The operation of the motor 84 drives the chains 80, thereby moving the rods up or down. The motor 84 is connected to an electronic control unit, which controls the operation of the motor 84 by sending drive signals to the motor 84.

In the example of FIG. 4, the paper tray 14 is placed on a paper tray carrier 86 and transported by the user. When the rods 72 are in the lowered position, the user pushes the paper tray carrier 86 with the paper tray 14 on into the paper stack container 15. This allows the rods 72 to be inserted beneath the paper tray 14.

Figure 5:
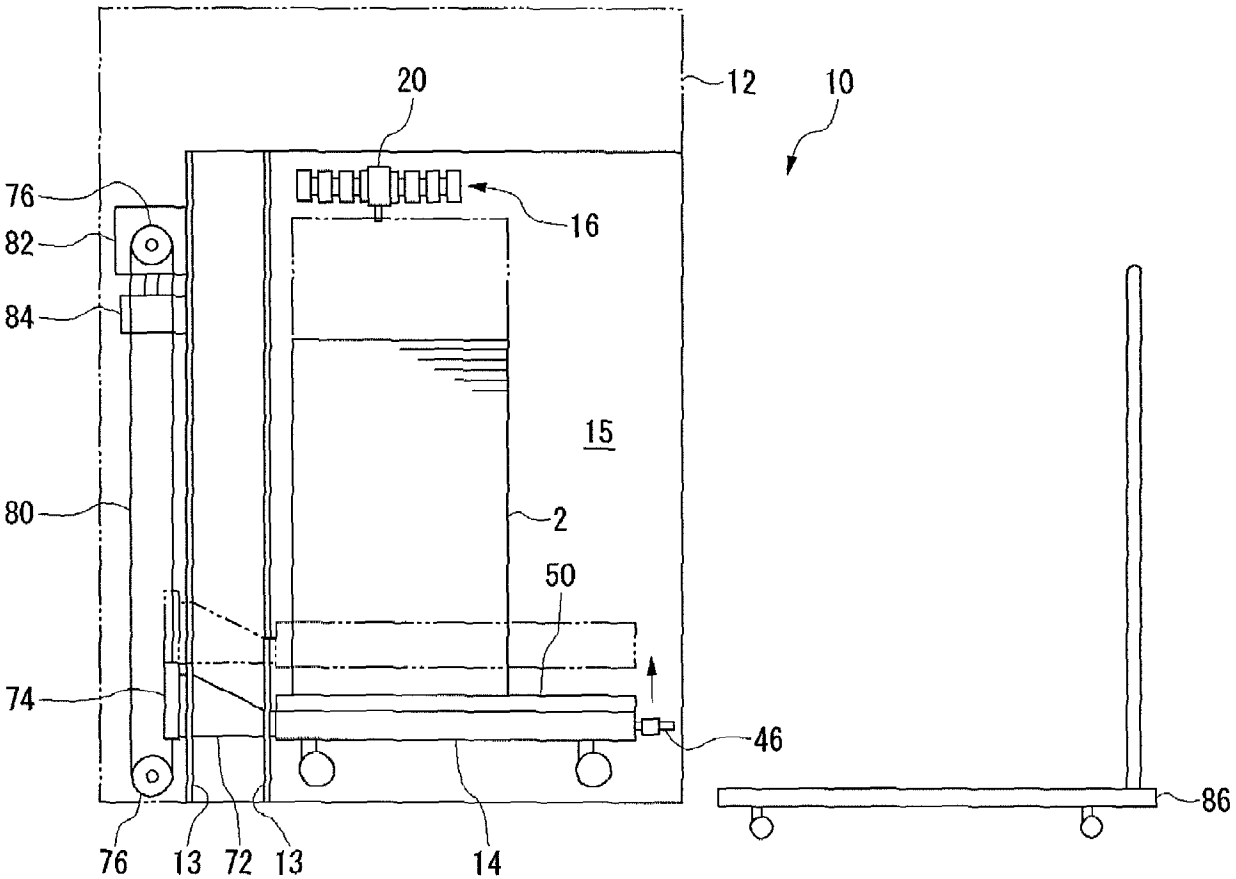
FIG. 5 is a right side view of the paper feeding apparatus with a paper tray installed on the body thereof.

FIG. 5 is a right side view of a paper feeding apparatus 10, in which the paper tray 14 has been installed on the body 12 thereof. After the paper tray carrier 86 is inserted into the paper stack container 15, the pressing of a paper tray installation button (not shown) provided on the body 12 by the user operates the motor 84 to move the rods 72 upward for a short distance, with the result that the paper tray 14 is lifted for a short distance by the rods 72. With the paper tray 14 lifted in this manner, the paper tray carrier 86 can be easily pulled out of the paper stack container 15.

When a paper stack is not in a proper horizontal position, the user connects the hose to the third air valve 46 and turns on a switch (not shown) of the air pump 42 provided on the body 12. This connection will blow air upward from the paper mounting surface 50, thus making it easier for the user to manually shift the paper stack 2 horizontally.

After placing the paper stack 2 in a horizontal position, the user stops the operation of the air pump 42 by turning off the switch of the air pump 42. The user then disconnects the hose from the third air valve 46, connects the hose to the second air valve 40, and closes the door 32. Thereafter, the user can start paper feeding by pressing a start button (not shown), which instructs the start of paper feeding. A detailed description of the operation procedure of the paper feeding apparatus 10 after the pressing of the start button is referenced in the context of FIG. 6.

Figure 6:
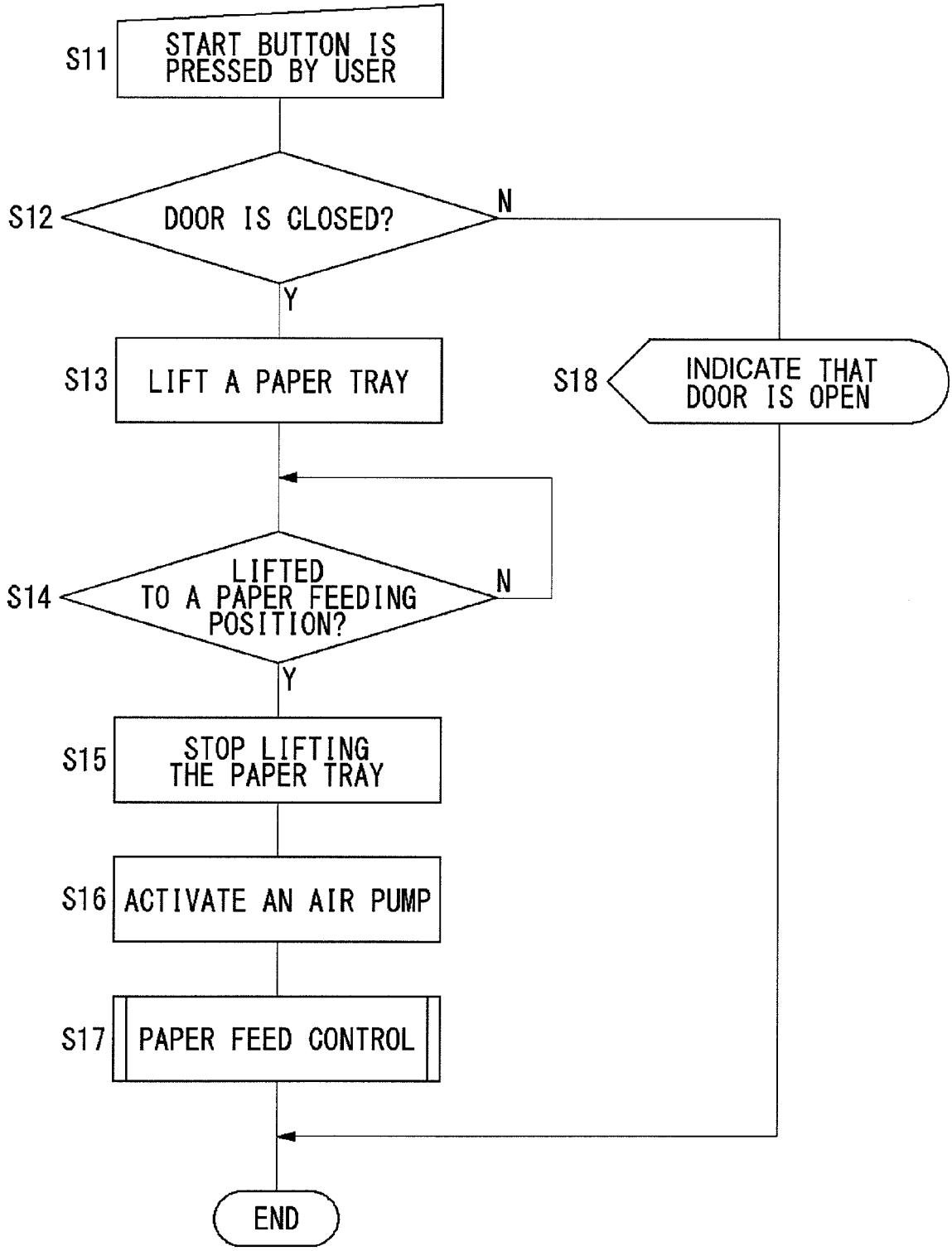
FIG. 6 is a flowchart: showing an operation procedure of a paper feeding apparatus according to a first embodiment when a start button is pressed.

FIG. 6 is a flowchart illustrating an exemplary operation procedure of a paper feeding apparatus 10 according to an embodiment of the present invention. The processing illustrated in this flowchart commences with the press of the start button by the user.

When the start button is pressed by the user (S11), the electronic control unit determines whether the door 32 is closed based on the result of detection by the opening/closing sensor 33 (S12). When it is determined that the door 32 is closed (Y of S12), the electronic control unit operates the motor 84 to lift the paper tray 14 (S13).

While the paper tray 14 is being lifted, the electronic control unit, using the result of detection by the paper height sensor 20, determines whether the uppermost sheet of the stack of paper on the paper fray 14 has lifted to a predetermined paper feeding position. This position allows the transport of the sheet by the paper feeder 16 (S14). When it is determined that the uppermost sheet of the stack has not yet lifted to the paper feeding position (N of S14), fee electronic control unit continues the determination of S14 while allowing the further rise of the paper tray 14.

When it is determined that the uppermost sheet of the stack has risen to the paper feeding position (Y of S14), the electronic control unit stops the operation of the motor 84 to stop the lift of the paper tray 14 (S15). The air ump is then activated (S16). Air is supplied to the first air-blowing member 52, the second air-blowing member 54 and the third air-blowing member 56, With the activation of the air pump, the electronic control unit performs paper feed control (S17). Paper feed control may include control of air blowing by the air-blowing structure 57, the first air-blowing member 52, the second air-blowing member 54, blowing of air to the upper end of the stack of paper, paper feeding by the paper feeder 16, halting and accumulation of sheets by the buffer mechanism 22, discharge of sheets to a finishing apparatus, and so forth. Upon completion of predetermined paper feed control, the processing illustrated in the present flowchart comes to an end.

In the event that the door 32 is determined to be open (N of S12), the electronic control unit displays an indication on a display (not shown) on the body that the door 32 is open (S18). At this time, the electronic control unit does not allow the lift of the paper tray 14. Accordingly, the stack of sheets on the paper tray 14 cannot be lifted to the paper feeding position so that the paper feeding by the paper feeder 16 is inhibited.

In this manner, the electronic control unit may inhibit the feeding of sheets by the paper feeder 16 when air is being supplied to the paper tray 14, namely the air-blowing outlets 70. As a result, when the user is shifting a slack of paper on the paper mounting surface 50 to a proper horizontal position, there will not be any paper feeding by the paper feeder 10 thus making it easier for the user to shift the stack on the paper mounting surface 50. This will also raise the degree of safety for the user.

Figure 7:
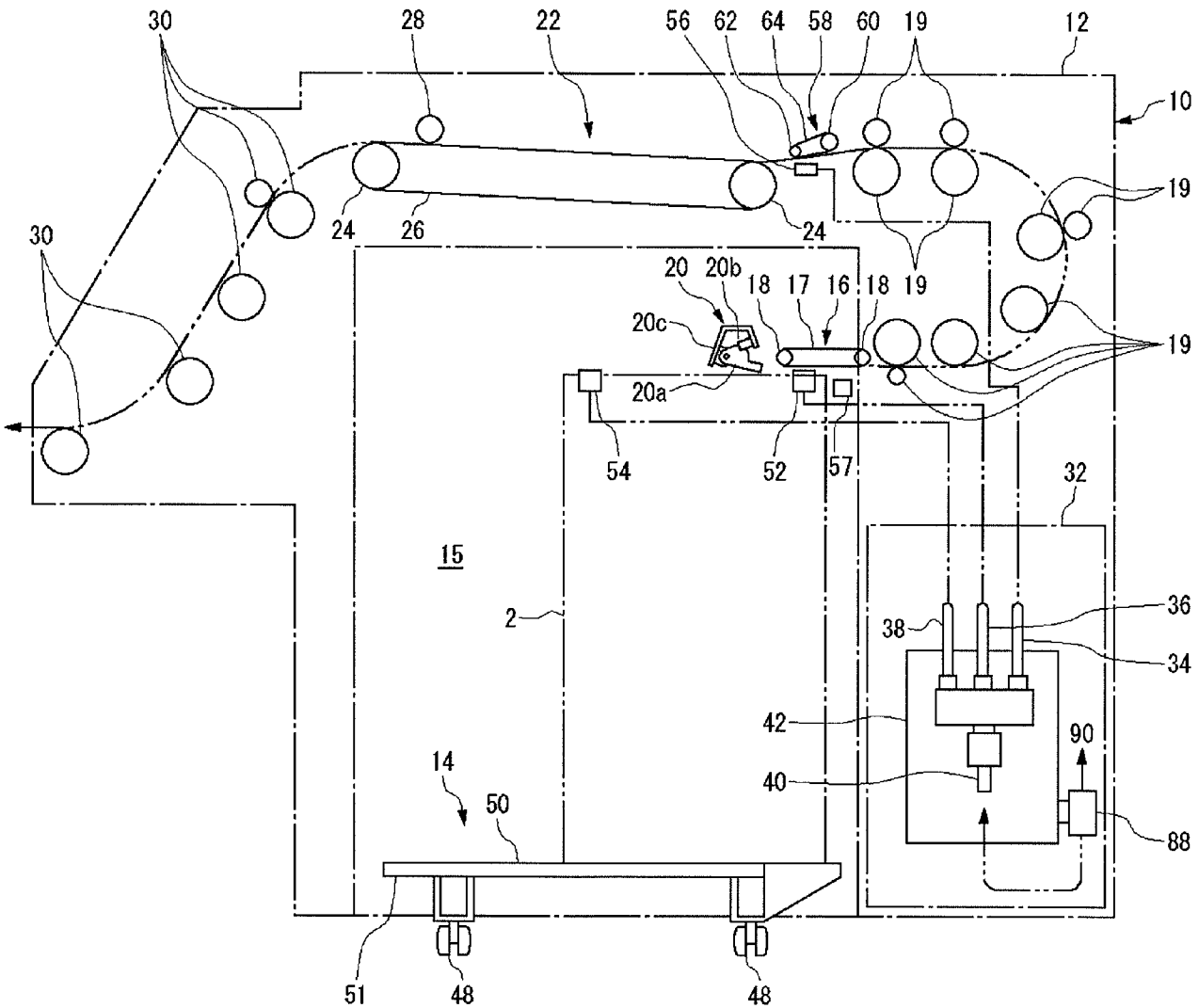
FIG. 7 is a front view of a paper feeding apparatus according to a second embodiment of the present invention.
Figure 8:
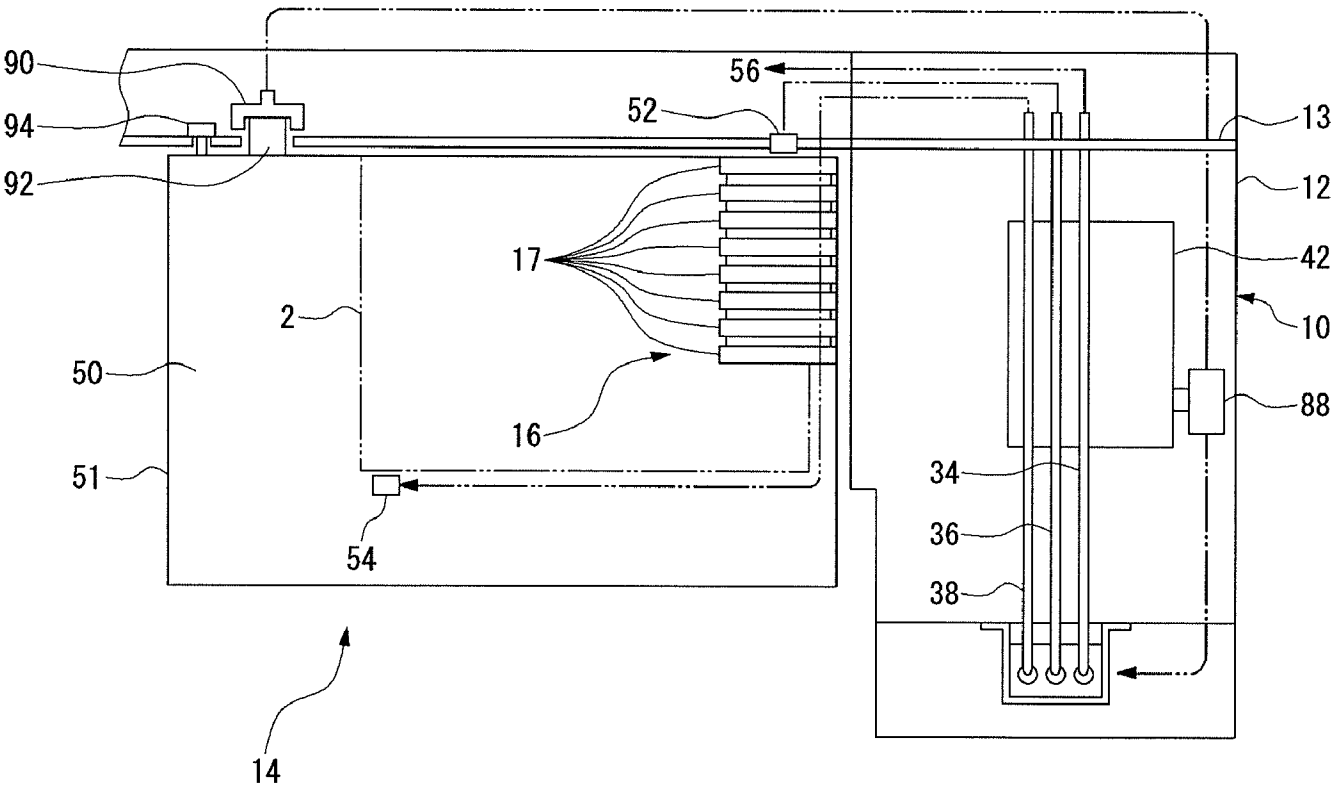
FIG. 8 is a top view of the paper feeding apparatus according to a second embodiment of the present invention.

FIG. 7 is a front view of a paper feeding apparatus 10 according to a second exemplary embodiment of the present invention. FIG. 8 is a top view thereof. In the present figure, the same components as those of the paper feeding apparatus 10 and as described in the context of the first exemplary embodiment will be denoted with the same reference numerals and the repeated description thereof will be omitted.

A paper feeding apparatus 10 according to the present embodiment includes an electromagnetic valve 88, a fourth air valve 90, a connecting member 92, and a paper tray installation sensor 94. The electromagnetic valve 88, which is disposed in the vicinity of the air pump 42, is connected to each of the air pump 42, the second air valve 40, and the fourth air valve 90.

When the electromagnetic valve 88 is not operating, communication between the air pump 42 and the second air valve 40 and communication between the air pump 42 and the fourth air valve 90 are both blocked. Regardless of whether the electromagnetic valve 88 is operating, communication between the second air valve 40 and the fourth air valve 90 is always blocked. The electromagnetic valve 88 is connected to the electronic control unit, which controls the operation of the electromagnetic valve 88 by controlling the power supplied thereto.

The fourth air valve 90 is fixed to a frame 13 located in the rear of the paper stack container 15. The connecting member 92 is provided on the paper tray 14. The connecting member 92 is disposed in a position for coupling with the fourth air valve 90 when the paper tray 14 is installed on the body 12. Therefore, as the paper tray 14 is installed on the body 12, the fourth air valve 90 as an air passage for fee air pump 42 and the connecting member 92 as an air passage for the paper tray 14 are coupled with each other thus enabling the supply of air from the air pump 42 to the paper fray 14. This arrangement accomplishes the coupling of the two air passages more readily than the case where the user manually connects and disconnect the hose to and from the air valve.

The paper tray installation sensor 94 detects the installation of the paper tray 14 on the body 12. The paper tray installation sensor 94 is connected to the electronic control unit, and the result of detection by the paper tray installation sensor 94 is outputted to the electronic control unit.

Figure 9:
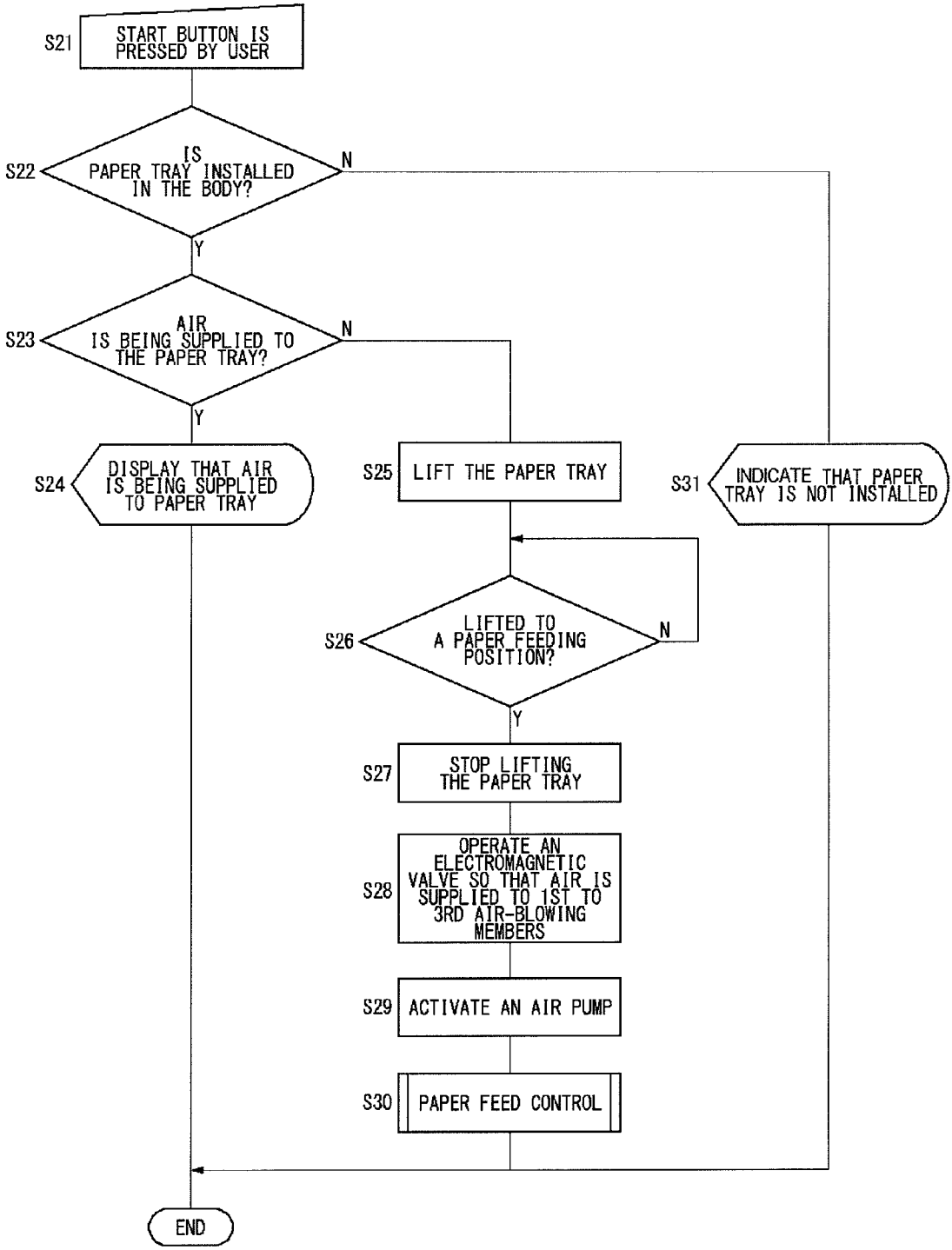
FIG. 9 is a flowchart showing an operation procedure of a paper feeding apparatus according to a second embodiment when a start button is pressed.

FIG. 9 is a flowchart showing an operation procedure of a paper feeding apparatus 10 according to the embodiment described in the context of FIG. 8. The processing in this flowchart is started with the press of the start button by the user.

When the start button is pressed by the user (S21), the electronic control unit determines whether the paper tray 14 is installed on the apparatus body based on the result of detection by the paper tray installation sensor 94 (S22). When it is determined that the paper fray 14 is not installed on the body 12 (N of S22), the electronic control unit displays on the display provided on the body 12 indicating that the paper tray 14 is not installed thereon (S31) and completes the processing in this flowchart without performing any paper feed.

When it is determined that the paper tray 14 is installed on the body 12 (Y of S22), the electronic control unit, by referring to the stale of control of the electromagnetic valve 88 and the air pump 42, determines whether air is being supplied to the paper tray 14, namely the air-blowing outlets 70 (S23). The electronic control unit determines that air is being supplied to the air-blowing outlets 70 when the electromagnetic valve 88 is being so controlled as to establish communication between the air pump 42 and the fourth air valve 90 and at the same time the air pump 42 is on. Otherwise, the electronic control unit determines that air is not being supplied to the air-blowing outlets 70.

When it is determined that air is being supplied to the air-blowing outlets 70 (Y of S23), the electronic control unit displays on the display provided on the body 12 indicating that air is being supplied to the paper tray 14 (S24) and completes the processing in this flowchart without performing any paper feed. In this manner, the paper feeding apparatus 10 inhibits the feeding of sheets when air is being supplied to the paper tray 14.

When it is determined that air is not being supplied to the air-blowing outlets 70 (N of S23), the motor 84 is operated to start the lift of the paper tray 14 (S25). Note that the description of S25 to S27, which is the same as that for S13 to S15 in FIG. 6, is omitted.

When the stack of sheets has lifted to the paper feeding position, the electronic control unit operates the electromagnetic valve 88 such that air is supplied to the first air-blowing member 52, the second air-blowing member 54, and the third air-blowing member 56. That is, the air pump 42 and the second air valve 40 are communicated with each other (S28).

Following the operation of the electromagnetic valve 88, the electronic control unit operates the air pump 42 (S29) and performs a paper feed control (S30). Note that the paper feed control in this case is the same as that in S17 of FIG. 6. Upon completion of predetermined paper feed control, the processing in the illustrated flowchart comes to an end.

Figure 10:
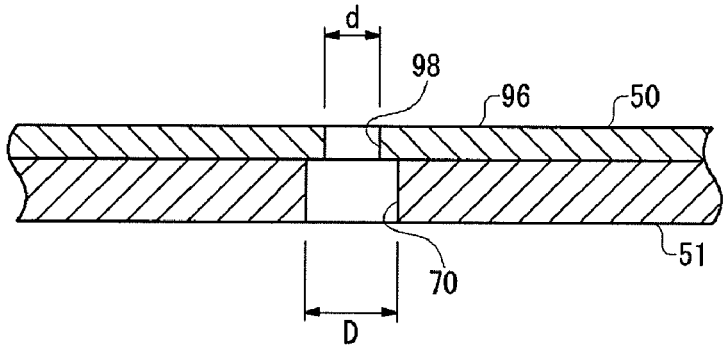
FIG. 10 shows an example where, in a paper tray according to the third embodiment of the present invention, air-blowing outlets in a tray plate have a wider opening area than air-blowing outlets in a slipping sheet.
Figure 11:
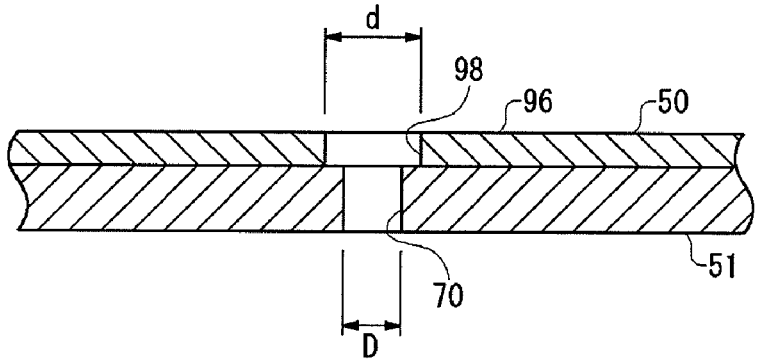
FIG. 11 shows an example where, in a paper tray according to the third embodiment of the present invention, air-blowing outlets in a slipping sheet have a wider opening area than air-blowing outlets in a tray plate.

FIGS. 10 and 11 are sectional views taken along a plane including the center of an air-blowing outlet 70 in a tray plate 51 of a paper tray 14 of a paper feeding apparatus according to another embodiment of the present invention. The paper tray in the present embodiment includes a slipping sheet 96. The slipping sheet 96 is a sheet made of a material with smaller coefficient of friction against the sheet of paper than the tray plate 51, such as fluororesin material, nickel-fluororesin material, graphite resin material, molybdenum disulfide resin material, or the like. The slipping sheet 96 operates such that fee stack of paper thereon can be horizontally shifted more easily. The slipping sheet 96 is fixed with an adhesive to the tray plate 51. With the paper tray 14 according to the present embodiment, the top surface of the slipping sheet 96 serves as a paper mounting surface 50. The slipping sheet 96 can be fixed with screws or the like to the tray plate 51.

The slipping sheet 96 is configured with air-blowing outlets 98 that come on top of the air-blowing outlets 70 in the tray plate 51. As a result, the air-blowing outlets 70 in the tray plate 51 may not be stopped up. The air-blowing outlets 98 provided in the slipping sheet 96 and the air-blowing outlets 70 provided in the tray plate 51 have their respective opening areas, one wider than, the other. Such an arrangement helps to avoid any reduction in the opening area between the air-blowing outlets 98 provided in the slipping sheet 96 and the air-blowing outlets 70 provided in the tray plate 51 notwithstanding the slipping sheet 96 being pasted to the tray plate 51 with some misalignment in the pasting positions.

FIG. 10 shows an example in which the air-blowing outlets 70 in the tray plate 51 have a wider opening area than, the air-blowing outlets 98 in the slipping sheet 96. In this example, both the air-blowing outlets 70 in the tray plate 51 and the air-blowing outlets 98 in the slipping sheet 96 are formed into round holes. The outlets 70 and 98 are disposed coaxially with each other when the slipping sheet 96 is pasted without causing the misalignment against the tray plate 51. In the case where the paste position is not aligned with the tray plate 51 and the air-blowing outlets 98 are not disposed coaxially with the air-blowing outlets 70, the air-blowing outlets are each formed such that the diameter D of each air-blowing outlet 70 in the tray plate 51 is larger than the diameter d of each air-blowing outlet 98 in the slipping sheet 96. The ratio of the diameter D of the air-blowing outlet 70 to the diameter d of the air-blowing outlet 98 is, in one embodiment, set as D/d=1.3 to 5.

FIG. 11 shows an example in which the air-blowing outlets 98 in the slipping sheet 96 have a wider opening area than the air-blowing outlets 70 in the tray plate 51. In this case, both the air-blowing outlets 70 in the tray plate 51 and the air-blowing outlets 98 in the slipping sheet 96 are formed into round holes and are disposed coaxially with each other when the slipping sheet 96 is pasted without causing the misalignment against the tray plate 51. In the case where the paste position of the slipping sheet is not aligned with the tray plate 51 and the air-blowing outlets 98 are not disposed coaxially with the air-blowing outlets 70, the air-blowing outlets are each formed such that the diameter d of each, air-blowing outlet 98 in the slipping sheet 96 is larger than the diameter D of each air-blowing outlet 70 in the tray plate 51. The ratio of the diameter d of the air-blowing outlet 98 to the diameter D of the air-blowing outlet 70, in one embodiment, is set as d/D=1.3 to 5.

The present invention is not limited to the exemplary embodiments so far described but any combinations of each component in each embodiment are also valid as the embodiments of the present invention. Various design modifications and alterations to each embodiment are also possible based on knowledge of those skilled in the art and embodiments with such modifications are within the scope of the present invention.

For example, in a modification of the first embodiment, the electronic control unit inhibits paper feeding after the stack of paper has lifted to the paper feeding position by controlling the paper feeder 16 such that it does not feed the sheets of paper. When the user presses the start button, it is likely that the action of shifting the stack of paper on the paper mounting surface 50 has already been taken. Hence, inhibition of paper feeding with paper tray 14 in the lifted position allows prompt paper feed control after the closing of the door 32.

In another modification of the first embodiment, when the air pump 42 is turned off by a press on the switch thereof by the user, the electronic control unit determines that air supply to the paper tray 14 has been stopped and thus allows the paper tray 14 to lift until the stack of paper thereon, reaches the paper feeding position. This arrangement enables prompt paper feed control after the start button is pressed.

In still another modification of the first embodiment, the paper feeding apparatus 10 includes a connection sensor for detecting the connection of a hose to the third air valve 46. The connection sensor, which is, for instance, structured as a switch, is disposed near the periphery of the third air valve 46 such that the detected thickness of the hose turns on the switch when the hose is connected to the third air valve.

When air can be supplied to the first air-blowing member 52, the second air-blowing member 54, or the third air-blowing member 56, with air being supplied to the air-blowing outlets 70, there may be cases where air blows out of the air-blowing outlets 70 during the process of paper feeding. In such a case, paper feeding can be rendered difficult because the slack of sheets may shift horizontally or because it is difficult to control the amount of air blown from the first air-blowing member 52, the second air-blowing member 54, or the third air-blowing member 56. Installation of a connection sensor as described above allows a more accurate detection of the supply of air to the air-blowing outlets 70. Accordingly when air is being supplied to the air-blowing outlets 70, it is possible to inhibit more reliably the supply of air to the first air-blowing member 52, the second air-blowing member 54, or the third air-blowing member 56. The connection sensor can be structured as a wind sensor or a pressure sensor.

In a modification of the second embodiment, when air is being supplied to the paper tray 14 at a press of the start button by the user, the electronic control unit stops the supply of air to the paper tray 14 by operating the electromagnetic valve 88 and then carries out paper feed control after supplying air to the first air-blowing member 52, the second air-blowing member 54, and the third air-blowing member 56. As mentioned above, when the user presses the start button, it is more likely that the action of shifting the stack of paper on the paper mounting surface 50 has already been taken. Even when air is being supplied to the air-blowing outlets 70, prompt paper feed control can be realized by pressing the start button, thereby selecting the destination of air supply from the first air-blowing member 52, the second air-blowing member 54, and the third air-blowing member 56.

In another modification of the first embodiment or the second embodiment, the paper feeding apparatus 10 is, for instance, provided with a touch panel that allows inputs and outputs of information. The electronic control unit causes the display of a start button on this touch panel. As the start button displayed on the touch panel is pressed by the user, the electronic control unit starts the operation of paper feeding by the paper feeder 16 or the like. When air is being supplied to the air-blowing outlets 70, the electronic control unit does not cause the display of the start button on the touch panel, thus inhibiting the feeding of sheets from the stack of paper. This arrangement effectively prevents an accidental pressing of the start button by the user when air is being supplied to the air-blowing outlets 70.

While the embodiments of the present invention have been described using specific terms, such description is for illustrative purposes only, and it is to be understood that changes and variations may be made without departing from the spirit or scope of the appended claims.

What is claimed is:

1. A paper feeding apparatus, comprising:

a paper tray having a paper mounting surface provided with an air-blowing outlet;

an air supplying structure configured to supply air to the air-blowing outlet;

a paper feeder configured to feed an uppermost sheet of a stack of paper on the paper mounting surface;

an air blower configured to blow air against the upper-end side of a stack of paper; and a switching structure configured to switch a destination of air supplied from the air supplying structure to either of the air-blowing outlet and the air blower, wherein the air-blowing outlet is configured to blow air against an approximately whole undersurface of the paper stacked on the paper mounting surface.

2. The paper feeding apparatus of claim 1, further comprising a control unit configured to inhibit the feeding of sheets of paper by the paper feeder when air is being supplied from the air supplying structure to the air-blowing outlet.

3. The paper feeding apparatus of claim 1, further comprising:

a door that may be opened and closed;

an opening-closing sensor configured to detect opening/closing of the door;

a preventive structure configured to prevent the closing of the door when a destination of air supplied from the air supplying structure has been switched to the air-blowing outlet; and a control unit configured to inhibit the feeding of sheets of paper by the paper feeder when the opening of the door has been detected.

4. The paper feeding apparatus of claim 1, wherein the paper tray is detachable.

5. The paper feeding apparatus of claim 4, wherein the paper tray is attached and an air passage connecting to the air supplying structure and an air passage connecting to the air-blowing outlet are coupled with each other such that air is supplied from the air supplying structure to the air-blowing outlet.

6. The paper feeding apparatus of claim 1, further comprising:

an instruction input unit configured to receive an instruction input for paper feeding from a user; and a control unit configured to control the switching structure and to switch a destination of air supply to the air-blower when the destination of the air supply has been switched to the air-blowing outlet at the time of reception of an instruction input for paper feeding.

7. The paper feeding apparatus of claim 1, the paper tray including:

a paper feed plate; and a slipping sheet with a smaller coefficient of friction against the sheet of paper than the paper feed plate, the slipping sheet configured to be fitted onto the paper feed plate in such a manner as to form a paper mounting surface.

8. The paper feeding apparatus of claim 7, wherein the paper feed plate includes a first opening, the slipping sheet includes a second opening, and wherein of the first opening and the second opening, one of which has a wider opening area than the other, and wherein the openings are disposed one on top of the other to form the air blowing outlet.

9. The paper feeding apparatus of claim 7, wherein the slipping sheet is formed of material selected from the group consisting of: any fluororesin material, nickel-fluororesin material, graphite resin material, or molybdenum disulfide resin material.

10. The paper feeding apparatus of claim 1, wherein the air blower includes a side-air blower configured to blow air to a side, parallel to a transport direction of a stack of paper, and in the vicinity of a front end in the transport direction.

11. The paper feeding apparatus of claim 1, wherein the air blower includes a side-air blower configured to blow air to a side, parallel to a transport direction of a stack of paper, and in the vicinity of a rear end in the transport direction.

12. The paper feeding apparatus of claim 1, the air blower including:

a first side-air blower configured to blow air to one side, parallel to a transport direction of a stack of paper, and in the vicinity of a front end in the transport direction;

and a second side-air blower configured to blow air to the other side, parallel to the transport direction of a stack of paper, and in the vicinity of a rear end in the transport direction.

13. A paper feeding apparatus, comprising:

a paper tray having a paper mounting surface provided with an air-blowing outlet;

a buffer structure which temporarily halts a plurality of stacked papers transported from the paper tray;

a buffer air blower configured to blow air to an undersurface of paper entering the buffer structure;

an air supplying structure configured to supply air to the air-blowing outlet and the buffer air blower; and a paper feeder configured to feed an uppermost sheet of a stack of paper on the paper mounting surface;

wherein the air-blowing outlet is configured to blow air against an approximately whole undersurface of the paper stacked on the paper mounting surface.

14. The paper feeding apparatus of claim 13, further comprising a control unit that inhibits the feeding of sheets of paper by the paper feeder when air is being supplied to the air-blowing outlet from the air supplying structure.

15. The paper feeding apparatus of claim 13, wherein the paper tray is detachable.

16. The paper feeding apparatus of claim 15, wherein the paper tray is attached, and an air passage connecting to the air supplying structure and an air passage connecting to the air-blowing outlet are coupled with each other such that air is supplied from the air supplying structure to the air-blowing outlet.

17. The paper feeding apparatus of claim 13, further comprising a switching structure that switches a destination of air supplied from the air supplying structure to either of the air-blowing outlet and the air blower.

* * * * *